United States Patent [19]

McGinniss

[11] 4,456,481

[45] Jun. 26, 1984

[54] HOT WORKABILITY OF AGE HARDENABLE NICKEL BASE ALLOYS

[75] Inventor: Robert L. McGinniss, Charlotte, N.C.

[73] Assignee: Teledyne Industries, Inc., Monroe, N.C.

[21] Appl. No.: 475,227

[22] Filed: Mar. 14, 1983

Related U.S. Application Data

[63] Continuation-in-part of Ser. No. 300,103, Sep. 8, 1981, Pat. No. 4,376,650.

[51] Int. Cl.[3] ..... C22B 23/00

[52] U.S. Cl. ..... 75/82; 75/49; 75/129; 75/130.5; 420/443; 420/582

[58] Field of Search ..... 75/49, 129, 82, 130.5; 420/443, 582

[56] References Cited

U.S. PATENT DOCUMENTS

| | | | |
|---|---|---|---|
| 3,467,167 | 9/1969 | Mahin | 75/49 |
| 3,575,734 | 4/1971 | Muzyka et al. | 148/2 |
| 3,607,229 | 9/1971 | Knuppel | 75/49 |
| 3,850,624 | 11/1974 | Hulit et al. | 75/135 |
| 3,907,552 | 9/1975 | Kennedy | 75/122 |
| 4,376,650 | 3/1983 | McGinness | 75/129 |

FOREIGN PATENT DOCUMENTS

| | | |
|---|---|---|
| 2262120 | 9/1975 | France . |
| 1035250 | 7/1966 | United Kingdom . |
| 1180974 | 2/1970 | United Kingdom . |

OTHER PUBLICATIONS

Metals Abstracts, vol. 12, p. 50, Abstract No. 31-2524, S. Yamaguchi et al., "Effect of Minor Elements on Hot Workability of Nickel-Base Superalloys", Metal Technology, May 1979, pp. 170-175.

*Primary Examiner*—Peter D. Rosenberg
*Attorney, Agent, or Firm*—Bell, Seltzer, Park & Gibson

[57] ABSTRACT

Very significant improvements in the hot workability of an age hardenable nickel base alloy containing 14 to 20 percent chromium, 1.4 to 5.3 percent titanium, 1.2 to 4.7 percent aluminum, 8 to 22 percent cobalt, up to 10 percent molybdenum, up to 3.5 percent tungsten, 0.004 to 0.040 percent boron, 0.02 to 0.15 percent carbon and about 52 to about 62 percent nickel are achieved by melting the raw materials under vacuum in the presence of lime, and forming a desulfurizing lime slag on the surface of the molten raw materials, and thereafter adding magnesium thereto just prior to casting the alloy, preferably while maintaining the molten raw material under an inert gas atmosphere.

7 Claims, No Drawings

HOT WORKABILITY OF AGE HARDENABLE NICKEL BASE ALLOYS

CROSS-REFERENCE TO RELATED APPLICATION

This is a continuation-in-part of commonly owned copending application Ser. No. 300,103, filed Sept. 8, 1981, now U.S. Pat. No. 4,376,650 issued Mar. 15, 1983.

FIELD AND BACKGROUND OF THE INVENTION

This invention relates to a method for improving the hot workability of an age hardenable nickel base alloy and to an alloy having such improved hot workability properties.

In the commercial production of certain age hardenable nickel base alloys, severe difficulties have been encountered during hot rolling of the cast ingots and wrought billet, resulting in cracking along the surface. This cracking necessitates significant amounts of grinding and loss of usable alloy, thereby significantly lowering the yield. Problems with hot working have also been experienced during subsequent forging of the wrought bar into parts or shapes, resulting in cracking.

One such alloy is commercially known by the designation U-720 and has the following nominal composition: about 18 percent chromium, about 5 percent titanium, about 2.5 percent aluminum, about 14.75 percent cobalt, about 3 percent molybdenum, about 1.25 percent tungsten, about 0.035 percent boron, about 0.035 percent carbon, about 0.037 percent zirconium, up to 0.1 percent columbium, up to 0.1 percent tantalum, up to 0.1 percent vanadium, up to 0.1 percent copper, up to 0.50 percent iron, up to 0.15 percent silicon, up to 0.15 percent manganese, up to 0.1 percent phosphorus, up to 0.0025 percent silver, up to 0.01 percent sulfur, and the balance nickel.

The above-noted copending application has disclosed that significant improvements in the hot workability of certain age hardenable nickel base alloys, such as U-720, can be achieved by deliberate additions of lime and magnesium under specified conditions during melting of the alloy. More specifically, significant improvements in the hot workability of the alloy are achieved by melting the appropriate raw materials for the alloy under a vacuum in the presence of lime and forming a desulfurizing lime slag on the surface of the molten raw materials, and thereafter adding a small but significant amount of magnesium thereto just prior to casting the alloy, preferably while under an inert gas atmosphere.

SUMMARY OF THE INVENTION

From further developmental work utilizing the lime and magnesium practice first described in the above-noted copending application, it has now been discovered that significant improvements in hot workability can be achieved in a wide variety of age hardenable nickel base alloys in addition to those described in said copending application.

The present invention is applicable to the production of the class of age hardenable nickel base alloys having the following composition: about 14 to about 20 percent chromium, about 1.4 to about 5.3 percent titanium, about 1.2 to about 4.7 percent aluminum, about 8 to about 22 percent cobalt, up to about 10 percent molybdenum, up to about 3.5 percent tungsten, about 0.004 to about 0.040 percent boron, about 0.02 to about 0.15 percent carbon, up to about 0.09 percent zirconium, up to about 3.5 percent columbium, and about 52 to about 62 percent nickel. This class of alloys may also include minor amounts of other elements and incidental impurities including, but not limited to, up to about 0.1 percent tantalum, up to about 0.1 percent vanadium, up to about 0.1 percent copper, up to about 2 percent iron, up to about 0.15 percent silicon, up to about 0.15 percent manganese, up to about 0.1 percent phosphorus, up to about 0.1 sulfur and up to about 0.0025 percent silver.

Nominal compositions of a number of commercially available alloys which would benefit from the lime and magnesium practice of this invention are given in Table 1.

TABLE 1

| Alloy | A | B | C | D | E | F | G | H | I | J |
|---|---|---|---|---|---|---|---|---|---|---|
| C | .04 | .04 | .08 | .08 | .13 | .15 | .07 | .14 | .04 | .035 |
| Mo | 4.25 | 5.00 | 10.00 | — | 4.2 | 3.5 | — | 4.7 | 6.25 | 3.0 |
| W | — | — | — | — | — | 3.5 | — | — | 1.0 | 1.25 |
| Cr | 19.5 | 15.3 | 19.0 | 19.0 | 14.7 | 14.0 | 19.5 | 15.5 | 19.0 | 18 |
| Ni | Bal* | Bal* | Bal* | Bal* | Bal* | Bal* | Bal* | Bal* | Bal* | Bal* |
| Co | 14.0 | 17.0 | 11.0 | 18.75 | 15.25 | 8.0 | 16.0 | 21.5 | 12.5 | 14.75 |
| Cb | — | — | — | — | — | 3.5 | — | — | — | — |
| Zr | .05 | — | — | — | — | .05 | .05 | .09 | — | .04 |
| Ti | 3.0 | 3.5 | 3.15 | 3.0 | 3.45 | 2.5 | 2.4 | 1.4 | 3.05 | 5.0 |
| Al | 1.3 | 4.0 | 1.5 | 3.0 | 4.30 | 3.5 | 1.5 | 4.7 | 2.0 | 2.5 |
| B | .006 | .024 | .006 | .005 | .016 | .012 | .005 | .007 | .007 | .035 |

*Ni and incidental impurities

The improved hot workability and other desirable characteristics achieved in accordance with the present invention are believed to be attributable, at least in part, to the critical combination of magnesium and sulfur content provided in the alloy by the combined use of lime and magnesium addition in the melting operation. Melting of the raw materials in the presence of lime, together with the addition of magnesium just prior to casting of the molten alloy, are believed to contribute to the hot workbility of the alloy by removing and/or tying up sulfur present as an impurity in the raw materials. Specifically, the addition of lime to the molten raw materials is believed to result in removal of major quantities of the sulfur impurity. The subsequent addition of magnesium is believed to further contribute to the hot workability properties by tying up significant amounts of sulfur which may remain in the alloy following the lime treatment. Because of the high vapor pressure of magnesium, it is preferred, in order to obtain the desired residual levels of magnesium in the alloy, that the magnesium be added to the molten raw materials under an inert gas back pressure and that the molten materials then be promptly poured from the furnace to form ingots.

It has been observed that alloys exhibiting improvements in hot workability pursuant to the lime and magnesium practice of this invention are characterized by a magnesium content within critical limits of from 10 to 100 parts per million and a sulfur content of no more than 50 parts per million. Preferably, the lime and magnesium practice is carried out in such a manner that the magnesium content is within the range of 10 to 60 parts per million and the sulfur content no more than 30 parts per million.

Thus, in accordance with a further aspect of the present invention, there is provided an age hardenable nickel base alloy which is characterized by excellent hot workability and which consists essentially of 14 to 20 percent chromium, 1.4 to 5.3 percent titanium, 1.2 to 4.7 percent aluminum, 8 to 22 percent cobalt, up to 10 percent molybdenum, up to 3.5 percent tungsten, 0.004 to 0.040 percent boron, 0.02 to 0.15 percent carbon, up to 0.09 percent zirconium, up to 3.5 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, up to 0.025 percent silver, no more than 50 parts per million sulfur, from 10 to 100 parts per million magnesium, and the balance essentially nickel.

The improved alloy of this invention is further characterized by having excellent hot workability, as evidenced by a rapid strain rate hot ductility significantly greater than that of similar alloys without the lime and magnesium practice. Hot workable alloys in accordance with this invention exhibit a rapid strain rate hot ductility at 1800° F. greater than 50 percent RA, and generally 60 percent RA or greater.

The use of lime in the melting of nickel base alloys has been practiced heretofore. Also, it has been recognized in the prior art that magnesium can contribute to hot workability of certain alloys. However, insofar as applicant is aware, nothing in the prior art has taught or suggested the use of lime in combination with magnesium addition as described herein. Further, nowhere does the prior art recognize or suggest that for the particular narrow class of alloys to which the present invention pertains the magnesium content must be maintained within critical narrow limits of from 10 to 100 parts per million and the sulfur content at no more than 50 parts per million, and most desirably from 10 to 60 parts per million magnesium and no more than 30 parts per million sulfur.

ILLUSTRATIVE EXAMPLES

The following examples are presented in order to give those skilled in the art a better understanding of the invention, but are not intended to be understood as limiting the invention.

EXAMPLE 1

Heats of an alloy having a nominal composition of about 18 percent chromium, about 5 percent titanium, about 2.5 percent aluminum, about 14.75 percent cobalt, about 3 percent molybdenum, about 1.25 percent tungsten, about 0.035 percent boron, about 0.037 percent zirconium, about 0.035 percent carbon, and the balance essentially nickel were prepared by vacuum melting in a vacuum induction furnace. In the first heat, no special additions or special melting practices were employed. Results of this effort were very poor, in that severe hot workability problems were encountered in rolling and subsequent forging.

In the next series of heats, in an effort to improve the hot workability of the alloy, about 0.5 percent dry lime was added to the vacuum melting furnace with the base charge of raw materials, producing a lime desulfurizing slag on the surface of the molten alloy. An improvement in hot workability was noted in the form of reduced cracking during hot rolling and increased forgeability during forging operations. However wide differences in workability were noted in different heats.

In the final series of heats, up to about 0.08 percent by weight magnesium was added to the lime desulfurized heat under inert gas back pressure at the end of the refine cycle, just prior to pouring from the vacuum furnace. A very significant improvement in hot workability was observed.

The magnesium and sulfur analyses of the thus produced heats are set forth in Table II below.

TABLE II

LIME AND SULFUR ANALYSIS

| | No Lime No Mg | Lime No Mg | Lime Mg |
|---|---|---|---|
| Number of samples | [illegible] | [illegible]1 | [illegible]5 |
| ppm Mg (mean) | [illegible]5 | [illegible].1 | [illegible]3.2 |
| Std. dev. | — | [illegible].57 | [illegible].7 |
| Number of samples | [illegible] | [illegible]6 | [illegible]5 |
| ppm S (mean) | [illegible]7 | [illegible]4.5 | [illegible]8.8 |

The hot workability of the above-noted alloys was quantitatively measured by rapid strain rate hot tensile testing. In this test, the specimens are first annealed at 2000° F. for one hour and air cooled. Tensile specimens, machined from the material being studied, are heated to a series of test temperatures approximating the range normally employed in hot working. The specimens are broken in tension, at a strain rate of approximately 0.05 inches per inch per second. The hot ductility is expressed as the percentage of reduction of area (%RA) of the broken bars, and this has been found to be a good indication of hot workability and to correlate well with actual results in hot rolling. With this alloy, it was noted that differences observed in hot workability correlated well with hot ductility at 1700° and 1800° F. These temperatures span the range of normal finishing temperatures experienced in hot rolling of this alloy.

The mean and standard deviation of the rapid strain rate hot ductility tests were calculated, and are set forth in Table III below.

TABLE III

RAPID STRAIN RATE HOT DUCTILITY

| | No Lime No Mg | | Lime No Mg | | Lime Mg | |
|---|---|---|---|---|---|---|
| Temperature | 1700° F. | 1800° F. | 1700° F. | 1800° F. | 1700° F. | 1800° F. |
| Number of Samples | 1 | 1 | 14 | 4 | 12 | 2 |
| % RA(mean) | 12 | 68 | 48.5 | [illegible]2.6 | 77.8 | [illegible]4.2 |

TABLE III-continued

| | RAPID STRAIN RATE HOT DUCTILITY | | | | | |
|---|---|---|---|---|---|---|
| | No Lime No Mg | | Lime No Mg | | Lime Mg | |
| Std. dev. | — | — | 14.3 | 11.4 | 8.5 | 4 |

Another measure of the improvement in hot workability observed for the lime plus Mg composition is yield. This is a measure of the amount of final bar product shipped expressed as a percentage of the amount of the starting material. Yield figures accumulated on lime plus Mg heats show a 34 percent increase over lime/-non-Mg heats.

Still another improvement noted for the lime plus Mg composition over the lime/non-Mg composition was a dramatic reduction in the frequency of sonic indications found in finish centerless ground bar product. Lime plus Mg heats average slightly less than one (1) sonic defect per ingot while lime/non-Mg heats had more than four (4) sonic defects per ingot.

EXAMPLE 2

To further illustrate the effects of magnesium and lime, two 3000 pound, production size heats were melted of a commercial nickel-base precipitation hardening alloy. The nominal chemical composition is listed as alloy B in Table I. The two heats were melted back-to-back from essentially the identical raw materials. Both had 0.5% lime additions with the initial melt charge but only the second heat had a Mg addition of 0.03%. Mg and S contents of these two heats are shown in Table IV. The product of these two heats were converted side-by-side in the same manner to six inch diameter bar and samples were taken from each heat for rapid strain rate hot tensile testing. Test results, summarized in Table IV, show a consistent improvement of just better than 10% in % RA at both 1700° F. and 1800° F. for the lime+magnesium heat.

TABLE IV

| Heat-Practice | Mg ppm | S ppm | | 1700° F. | 1800° F. |
|---|---|---|---|---|---|
| Heat V009 | 6 | 8 | Mean % RA | 37.9 | 58.5 |
| Lime, | | | Std. dev., | 4.4 | 5.0 |
| Non-Mg | | | No. of Tests | 5 | 4 |
| Heat V010 | 30 | 12 | Mean % RA | 41.9 | 64.6 |
| Lime + Mg | | | Std. dev., | 4.6 | 4.6 |
| | | | No. of tests | 3 | 5 |

EXAMPLE 3

A 50 pound heat of a commercial alloy (composition A in Table I) was melted employing the addition of 0.5% lime and 0.05% Mg. The resulting ingot analyzed at 0.023% Mg and 0.0010% S. This material was processed to 1¼" square bar by the same method as had been employed previously to produce heats with just lime and with no lime or Mg. Rapid strain rate hot tensile test results were compared as shown in Table V with the result of a very significant improvement in % RA at 1800° F. for the heat with both lime and magnesium.

TABLE V

| Heat Practice | Mg ppm | S ppm | No. of Tests | 1800° F. % RA |
|---|---|---|---|---|
| G671 Non-Lime, Non-Mg | N.A. | 34 | 1 | 60.5 |

TABLE V-continued

| Heat Practice | Mg ppm | S ppm | No. of Tests | 1800° F. % RA |
|---|---|---|---|---|
| G673 Lime, Non-Mg | N.A. | 17 | 1 | 50.9 |
| A152 Lime + Mg | 23 | 10 | 1 | 90.7 |

N.A. - not analyzed

In the drawings and specification, there have been set forth preferred embodiments of the invention, and although specific terms are employed, they are used in a generic and descriptive sense only and not for purposes of limitation.

That which is claimed is:

1. In a method for producing an age hardenable nickel base alloy containing 14 to 20 percent chromium, 1.4 to 5.3 percent titanium, 1.2 to 4.7 percent aluminum, 8 to 22 percent cobalt, up to 10 percent molybdenum, up to 3.5 percent tungsten, 0.004 to 0.040 percent boron, 0.02 to 0.15 percent carbon, up to 3.5 percent columbium, up to 0.09 percent zirconium and about 52 to about 62 percent nickel, and in which appropriate raw materials for producing an alloy of said composition are melted, refined, and thereafter cast into an ingot, the improvement which comprises improving the hot workability of the alloy by melting said appropriate raw materials under a vacuum in the presence of lime and forming a desulfurizing lime slag on the surface of the molten raw materials, and thereafter adding magnesium thereto just prior to casting.

2. A method as set forth in claim 1 wherein said step of adding magnesium just prior to casting is carried out in such a manner as to obtain in the cast alloy a magnesium content of from 10 to 100 parts per million and a sulfur content of no more than 50 parts per million.

3. A method as set forth in claim 1 wherein said step of adding magnesium just prior to casting is carried out in such a manner as to obtain in the cast alloy a magnesium content of from 10 to 60 parts per million and a sulfur content of no more than 30 parts per million.

4. A method as set forth in claim 1 wherein said step of adding magnesium just prior to casting is carried out while under an inert gas atmosphere.

5. In a method for producing an age hardenable nickel base alloy containing 14 to 20 percent chromium, 1.4 to 5.3 percent titanium, 1.2 to 4.7 percent aluminum, 8 to 22 percent cobalt, up to 10 percent molybdenum, up to 3.5 percent tungsten, 0.004 to 0.04 percent boron, 0.02 to 0.15 percent carbon, up to 0.01 percent zirconium, up to 3.5 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, and the balance essentially nickel except for incidental impurities, and in which appropriate raw materials for producing an alloy of said composition are melted, refined, and thereafter cast into an ingot, the improvement which comprises improving the hot workability of the alloy by melting said appropriate raw materials under a vacuum in the presence of lime and forming a desulfurizing lime slag on the surface of the molten raw materials, and thereafter maintaining the molten raw materials under an inert gas atmosphere while adding magnesium thereto just prior to casting so as to obtain in the cast alloy a magnesium content of 10 to 100 parts per million and a sulfur content of no more than 50 parts per million.

6. An age hardenable nickel base alloy characterized by having excellent hot workability and consisting essentially of 14 to 20 percent chromium, 1.4 to 5.3 percent titanium, 1.2 to 4.7 percent aluminum, 8 to 22 percent cobalt, up to 10 percent molybdenum, up to 3.5 percent tungsten, 0.004 to 0.040 percent boron, 0.02 to 0.15 percent carbon, up to 0.01 percent zirconium, up to 3.5 percent columbium, up to 0.1 percent tantalum, up to 0.1 percent vanadium, up to 0.1 percent copper, up to 2 percent iron, up to 0.15 percent silicon, up to 0.15 percent manganese, up to 0.1 percent phosphorus, no more than 50 parts per million sulfur, from 10 to 100 parts per million magnesium, and the balance essentially nickel.

7. An alloy according to claim 6 including no more than 30 parts per million sulfur and 10 to 60 parts per million magnesium.

* * * * *